United States Patent [19]

Huber

[11] Patent Number: 4,514,864

[45] Date of Patent: May 7, 1985

[54] SAFETY HELMET, ESPECIALLY FOR USERS OF AUTOMOTIVE VEHICLES

[75] Inventor: Siegfried Huber, Munich, Fed. Rep. of Germany

[73] Assignee: Bayerische Motoren Werke AG, Fed. Rep. of Germany

[21] Appl. No.: 447,099

[22] Filed: Dec. 6, 1982

[30] Foreign Application Priority Data

Dec. 9, 1981 [DE] Fed. Rep. of Germany ..... 3148725

[51] Int. Cl.[3] ..... A42B 3/02

[52] U.S. Cl. ..... 2/424; 2/436

[58] Field of Search ..... 2/424, 436, 410, 437, 2/9, 6, 10, 171.3, 423

[56] References Cited

U.S. PATENT DOCUMENTS

| | | | |
|---|---|---|---|
| 2,099,464 | 11/1937 | Bruner | 2/436 |
| 2,526,737 | 10/1950 | Farina | 2/436 |
| 2,579,942 | 12/1951 | MacLean | 2/410 X |
| 3,031,675 | 5/1962 | Dubach | 2/437 |
| 3,911,914 | 10/1975 | Johansson | 2/424 X |
| 4,101,980 | 7/1978 | Stepan et al. | 2/424 X |
| 4,290,150 | 9/1981 | Berthelot | 2/424 X |
| 4,354,285 | 10/1982 | Rudd | 2/424 |

FOREIGN PATENT DOCUMENTS

| | | | |
|---|---|---|---|
| 0072767 | 2/1983 | European Pat. Off. | 2/410 |
| 2903305 | 8/1979 | Fed. Rep. of Germany | 2/424 |
| 7611248 | 4/1977 | Netherlands | 2/424 |
| 732248 | 6/1955 | United Kingdom | 2/10 |
| 1456824 | 11/1976 | United Kingdom | 2/410 |
| 2048056 | 12/1980 | United Kingdom | 2/410 |
| 570359 | 9/1977 | U.S.S.R. | 2/424 |

OTHER PUBLICATIONS

*Rider* Magazine, "The New Nava 2AC with Air Control," Mar. 1984.

*Primary Examiner*—Peter Nerbun

*Attorney, Agent, or Firm*—Craig & Burns

[57] ABSTRACT

The safety helmet has a viewing opening which can be covered by a visor. Several vent openings and air passage openings are arranged at the chin protector of the safety helmet. Such openings terminate together into an air-collecting chamber provided on the inside of the chin protector. Two ventilating tubes extending to the top edge of the viewing opening lead away from this air-collecting chamber. An air stream produced by a pressure head passes through the vent openings—as well as through the air passage openings if the visor is opened somewhat—into the air-collecting chamber and is conducted by the ventilating tubes onto the inside of the visor, thereby substantially preventing any fogging of the visor by moisture precipitation.

13 Claims, 3 Drawing Figures

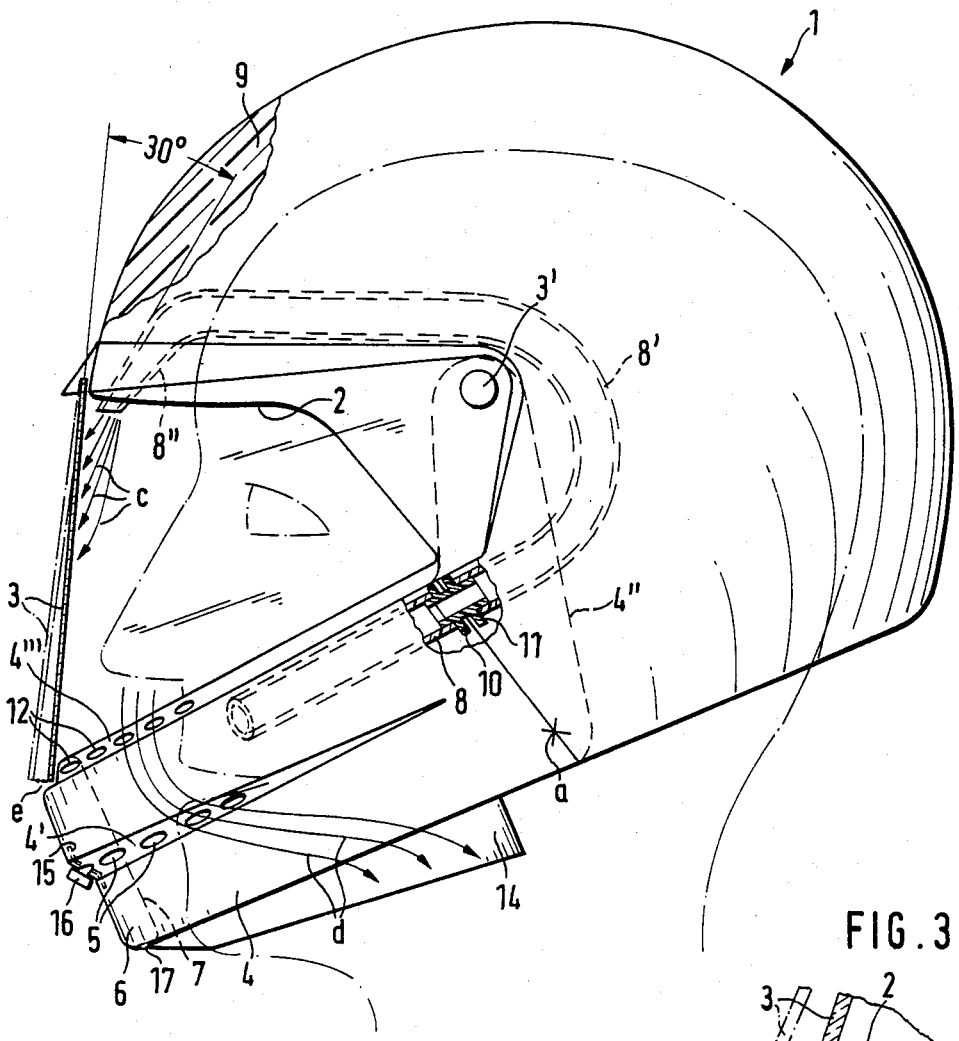
FIG. 2
FIG. 3
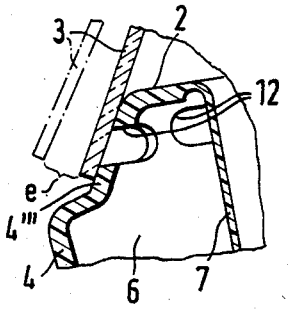

SAFETY HELMET, ESPECIALLY FOR USERS OF AUTOMOTIVE VEHICLES

TECHNICAL FIELD

The invention relates to a safety helmet.

BACKGROUND ART

In the conventional safety helmet, vent openings are provided at the bottom-positioned marginal region of the viewing opening and are of a slot shape. With the visor being closed, an air gap is formed between the bottom-located marginal zone of the visor and the outer surfaces of the rim of the viewing opening facing this marginal zone. While driving a motorcycle, due to the resulting pressure head, air flows through this gap to the vent openings and, via the latter, into the interior of the helmet. Although the vent openings are located at the level of the driver's mouth, the incoming air stream is also conducted to the driver's eyes, which can lead to tearing of the eyes and eye irritation. Because the vent openings are arranged merely along the marginal zone of the viewing opening, the air stream passing therethrough into the interior of the helmet cannot adequately prevent fogging of the inside of the visor with precipitated moisture.

The integral safety helmet disclosed in German Utility Model No. 7,837,986 has a flat air-conducting part at the chin protector. This part extends obliquely into the interior space of the helmet. The free end of this part lies in the vision field of the visor. Because the air-conducting part has an outer contour corresponding approximately to the mouth and nose portion of the wearer of the helmet, this air-conducting part can avoid, if anything at all, merely a fogging of the inside of the visor by the air directly escaping from the mouth and nose of the helmet wearer, which air is oriented toward the visor. However, because such air can spread within the entire interior of the helmet, the air-conducting part—especially in case of low outside temperatures—cannot entirely preclude fogging of the inside of the visor.

Finally, it is known from U.S. Pat. No. 3,727,235 to provide a jet helmet—that is, a protective helmet of a different type than the safety helmet discussed hereinabove—with a protective shield. An air-conducting element is mounted to the obliquely downwardly extending marginal portion of this protective shield, facing the protective helmet, and extends along this marginal portion. The air stream produced during driving of the motorcycle due to a pressure head is conducted along this air-conducting element to the inside of the protective shield, whereby the latter is to be kept free of moisture precipitation and the fogging caused thereby. However, because the protective shield, as mentioned above, is arranged at a jet helmet completely open at its underside, the air entering via the air-conducting element is made turbulent by the air flow always ambient on the underside of the helmet and thereby can also be disadvantageously conducted to the driver's eyes. Another, quite considerable disadvantage resides in the conventional safety helmet. During driving in moist, rainy weather, air having a high moisture content or also water droplets can pass from the outside to the inside of the safety helmet so that the latter cannot be kept free of fogging under the aforementioned weather conditions.

It is, therefore, an object of the invention to provide a device in a safety helmet of the type discussed above, by means of which the inside of the visor is kept free of fog from moisture precipitation by a controlled air conductance effectively directed toward the inside of the visor but deflected away from the driver's eyes, wherein the air stream generated is to contain air free of droplets even during moist weather conditions. In this connection, such air conductance is to be effected also in case of varying velocities of the vehicle, if possible.

SUMMARY OF THE INVENTION

Because the ventilating duct leading away from the air-collecting chamber is extended to the upper zone of the visor, an air stream passing through the vent openings during driving of a motorcycle and produced by mere pressure head is oriented obliquely from above directly onto the inside of the visor. The result is not only an extensive prevention of fogging of the visor with precipitated moisture, but also a possibility of intermixing of the air stream flowing downwardly away from the driver's eyes with the driver's breathing air, likewise oriented downwardly. The air stream, together with the breathing air, is exhausted, without draft, starting with a specific vehicle speed, by the vacuum ambient in the chin zone of the drive. This vacuum is generated during driving by the annular gap existing between the neck of the helmet wearer and the safety helmet proper. Although the air stream continuously fed into the interior of the helmet serves primarily for covering the inside of the visor, this air stream is also advantageous as supplied fresh air for the driver's welfare. Furthermore, a pressure compensation with respect to the outside air is obtained specifically in the region of the driver's face by the thus-introduced air stream, whereby the driver's comfort while wearing the helmet is enhanced.

According to another feature of the present invention, additional air passage openings leading into the air-collecting chamber are provided at the top-positioned marginal zone of the chin protector. These openings are sealed by the visor when the latter is, with its bottom-positioned marginal zone, in flat contact with the facing surface of the chin protector. The vent openings arranged along with the air passage openings at the chin protector provide the result that, when the air passage openings are sealed by the visor, air flows merely through the vent openings into the interior of the helmet during driving of a motorcycle. This is the case starting with an average vehicle speed of, for example, about 50 km/h. Accordingly, it is possible with the safety helmet of this invention to drive, with the visor being closed, from the maximum speed of the motorcycle on down to the aforementioned speed range. The interior of the helmet is advantageously ventilated without water being able to penetrate into this space. However, if the visor is opened manually by a gap, air can enter the air-collecting chamber through the air passage openings as well as through the vent openings and can flow from this chamber to the inside of the visor. It is hardly possible for water to enter the interior of the helmet by such gap. On account of the resulting air throughput, which is substantially larger as compared with a closed visor, air is conducted into the interior of the helmet at an even lower speed, as primarily encountered in city driving, namely, for example, starting with about 20 km/h. During this process, water which may have entered by the vent openings and air passage openings can accumulate in the air-collecting chamber arranged in the region of the chin protector on the inside of the latter. This water can drain off again from this chamber through a water drain opening provided for this purpose and leading to the underside of the helmet. Even during moist weather, air free of droplets passes into the interior of the helmet by the two ventilating tubes provided at the end zones of the air-collecting chamber. Since the ventilating tubes—arranged in a simple way as air-conducting ducts and being inserted in the lining of the safety helmet—have a large longitudinal extension, air moisture can be precipitated on their walls so that the ventilating tubes also contribute toward air dehumidification.

The vent openings provided at the chin protector can be closed off by means of a slide or a rubber-elastic cover entirely or partially, depending upon requirements. With a correspondingly dimensioned thickness, this can uncover the vent openings merely by air pressure. Because the vent openings are arranged at the chin protector in a section which, in turn, has a reinforcing effect with respect to force application and extends inwardly in a frustoconical shape, the chin protector is hardly weakened by the vent openings.

By constricting the flow cross section of the free ends of the ventilating tubes—which can also be achieved by a nozzle insert—an increase in the velocity of the exiting air as well as directional stability of the air stream can be attained.

These and other objects, features and advantages of the present invention will become more apparent from the following description when taken in connection with the accompanying drawings which show, for purposes of illustration, one embodiment in accordance with the present invention.

BRIEF DESCRIPTION OF THE DRAWINGS

FIG. 2 shows a lateral view of FIG. 1,

FIG. 3 shows an enlarged detail of FIG. 2 with the top-positioned rim of the chin protector.

DETAILED DESCRIPTION OF THE INVENTION

Figure 1:
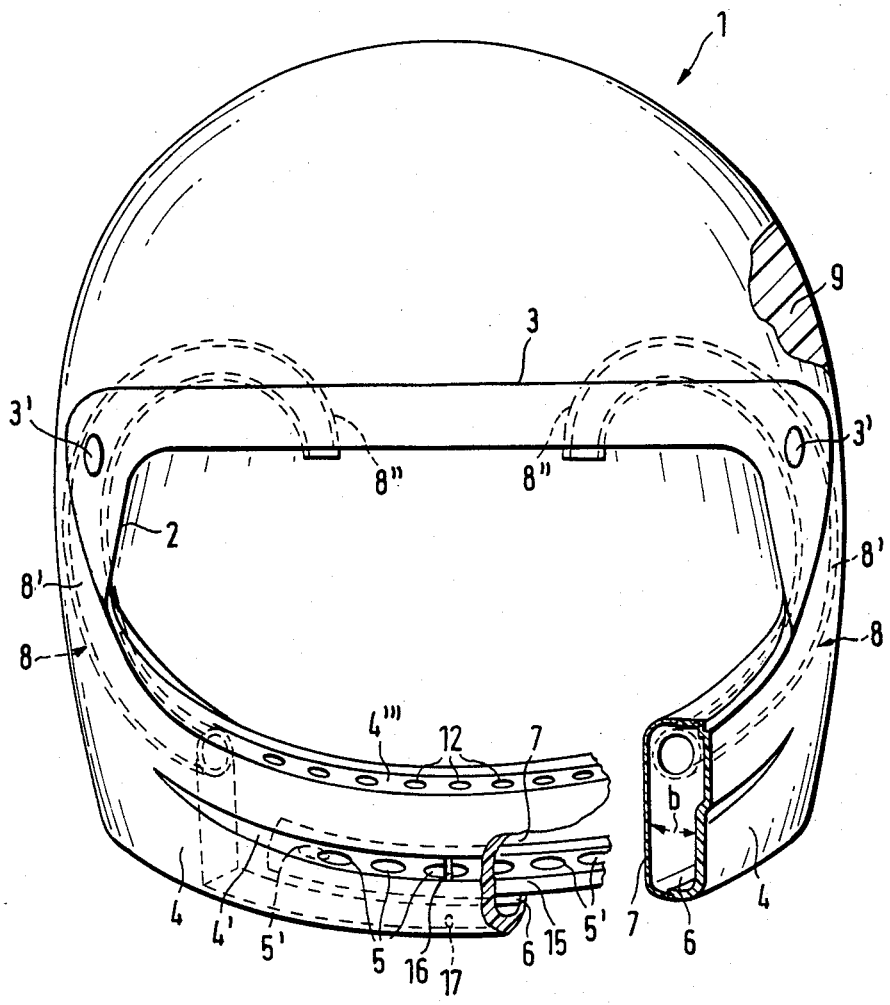
FIG. 1 shows a safety helmet in a frontal view.

The safety helmet 1, illustrated in FIG. 1 and FIG. 2, has a viewing opening 2 which can be covered by a visor 3. The latter is supported at the safety helmet 1 to be pivotable upwardly and downwardly by way of two opposed bearing pins 3' together with a chin protector 4 equipped with two lateral articulating members 4''. Because the visor 3 and the chin protector 4 are both articulated to the bearing pin 3', the visor 3 can be lifted and lowered independently of, or together with, the chin protector 4. When the chin protector 4 is provided upwardly, the visor 3 is perforce also displaced. The chin protector 4, in contact with the bottom part of the helmet along a parting line a, is equipped in the zone of its longitudinal line of symmetry with a section 4' extending inwardly in a frustoconical shape. Several vent openings 5 disposed side-by-side and extending horizontally in a slot configuration are arranged at this section. These vent openings 5 terminate into an air-collecting chamber 6 formed by a thin, rubber-elastic wall 7 attached at a spacing b to the inside of the chin protector 4 in an airtight fashion and extending approximately in parallel to this inside. This wall runs along the central zone of the chin protector 4 and corresonds to the height of the latter. A ventilating tube 8 serving as an air-conducting channel extends away from the two end zones of the air-collecting chamber 6 along the top-positioned rim of this chamber. Both ventilating tubes are inserted in the lining 9 of the safety helmet 1. They are joined thereto and are each extended by an arc 8' to their tube end section 8'' lying in the zone of the top rim of the viewing opening 2. These tube end sections are in the proximity of the visor 3 and are arranged so that they form, in lateral view (FIG. 2), toward the inside of the visor 3, an upwardly open angle of about 30°.

As can be seen from FIG. 1, the section of the ventilating tubes 8 leading away from the air-collecting chamber 6, as well as their arc 8', extend below and/or laterally offset with respect to the rims of the viewing opening 2, so that the view through this opening is not obstructed by the ventilating tubes 8. The free ends of the end sections 8'' of the ventilating tubes 8 are laterally offset from the plane of symmetry of the safety helmet 1 and lie approximately at the level of the top edge of the viewing opening 2. In order to obtain optimum air coverage for the inside of the visor 3, it is, of course, also possible to provide more than two ventilating tubes 8 leading away from the air-collecting chamber 6, if necessary. In order to raise the velocity of the air exiting from the ventilating tubes 8, the free ends of these tubes have narrowed flow cross sections which can be provided by reducing the tube cross section or by means of a nozzle inserted in the tube end sections 8''. Inasmuch as the chin protector 4 is supported to be raisable and lowerable at the safety helmet 1, the ventilating tubes 8 must also be divided in the zone of the parting line a. Their lower sections arranged in the chin protector 4 are pivotable with the latter, while their upper sections are fixed in the lining 9. To provide a seal for the mutually facing tube ends of the ventilating tubes 8, thus formed at the parting line a, that is when the chin protector 4 is swung downwards, as illustrated in FIG. 1 and FIG. 2, respectively cooperating sealing collars 10 and 11 are arranged at the tube ends.

In addition to the vent openings 5 located at the section 4' of the chin protector 4, which section extends inwardly in a frustoconical shape, a number of further air passage openings 12 are arranged side-by-side in the longitudinal central zone of the top-positioned edge region 4''' of the chin protector 4. These openings 12 lead, together with the vent openings 5, into the air-collecting chamber 6. The air passage openings 12 are formed, just as the vent openings 5, in a slot configuration with a horizontally extending longitudinal axis. As can be seen from FIG. 2 and FIG. 3, the surface of the top-positioned marginal zone 4''' of the chin protector 4, facing the inside of the visor 3, exhibiting the air passage openings 12, extends in the same oblique position as the inside of the visor 3 in its closed position shown in both figures with solid lines. This has the result that the air passage openings 12, when the visor 3 is closed, are sealed by the latter. The inside of this visor is in flat contact with the facing surface of the chin protector 4.

With the visor 3 of the safety helmet 1 closed, the air stream produced by a pressure head during driving of the motorcycle passes through the vent openings 5, through the air-collecting chamber 6, into the ventilating tubes 8. From the tube end sections 8'' thereof, the air stream, schematically illustrated with arrows c in FIG. 2, is oriented from above, away from the driver's eyes, directly onto the inside of the visor 3 so that thereby fogging of the visor by moisture precipitation is substantially prevented. If the visor 3 is opened by a gap e (shown with dashed lines in FIGS. 2 and FIG. 3), then air enters the air-collecting chamber 6 through the vent openings 5 as well as through the air passage openings 12, that is, a comparatively larger air throughput. The respective velocity ranges for the motorcycle have been set forth above. Because a vacuum exists in the chin zone of the driver during driving of the motorcycle, such vacuum causes the air entering the interior of the helmet to be exhausted by suction via the annular gap existing between the neck of the helmet wearer and the safety helmet 1, together with a driver's breathing air, which is likewise flowing downwardly, that is, in the same direction. This is illustrated schematically in FIG. 2 with arrows d. To improve suction removal of air, the rim 14 extending radially from the safety helmet 1 toward the helmet wearer's neck can be fashioned to project obliquely downwardly.

A slide 15 provided with vent openings 5' is mounted along the vent openings 5 on the inside of the frustoconical section 4' of the chin protector 4. These vent openings 5' are associated with the vent openings 5 and cooperate with the latter so that the vent openings 5 can be sealed off entirely or partially by the slide 15. For operating the slide 15, a handle 16 is arranged at the latter. Instead of the slide 15, it is also possible to provide on the inside of the chin protector 4 a rubber-elastic cover extending over the vent openings 5 and having such a thickness that it uncovers the vent openings 5 under corresponding air pressure. In order to avoid that flies or the like enter into the air-collecting chamber 6, the slide 15 and/or the rubber-elastic cover can be covered by a mesh filter. Any water which may have entered the air-collecting chamber 6 can be drained by a water drain hole 17 located in the zone of the lowest point of the air-collecting chamber and leading to the underside of the helmet.

While I have shown and described one embodiment in accordance with the present invention, it is understood that the same is not limited thereto but is susceptible of numerous changes and modifications as known to those skilled in the art, and I therefore do not wish to be limited to the details shown and described herein, but intend to cover all such changes and modifications as are encompassed by the scope of the appended claims.

I claim:

1. A safety helmet especially for users of automotive vehicles, comprising a viewing opening, visor means for the viewing opening, vent openings terminating into an air-collecting chamber located on the inside of a chin protector, at least one air-conducting channel leading from the air-collecting chamber to the upper zone of the viewing opening and the efflux direction of the air-conducting channel being extended from above obliquely and at an acute angle to the inside of the visor.

2. A safety helmet especially for users of automotive vehicles, comprising a viewing opening, visor means for the viewing opening, vent openings terminating into an air-collecting chamber located on the inside of a chin protector, at least one air-conducting channel leading from the air-collecting chamber to the upper zone of the viewing opening and the efflux direction of the air-conducting channel being extended from above obliquely and in an acute angle to the inside of the visor, wherein additional air passage openings leading into the air-collecting chamber are provided at a top-positioned marginal zone of the chin protector, these openings being sealed off by the visor when the latter is, with its bottom-positioned marginal zone, in flat contact with the facing surface of the chin protector.

3. The safety helmet according to claim 1, wherein the air conducting channel includes a ventilating tube inserted in the lining of the safety helmet.

4. A safety helmet especially for users of automotive vehicles, comprising a viewing opening, visor means for the viewing opening, vent openings terminating into an air-collecting chamber located on the inside of a chin protector, at least one air-conducting channel leading from the air-collecting chamber to the upper zone of the viewing opening and the efflux direction of the air-conducting channel being extended from above obliquely and at an acute angle to the inside of the visor, wherein the air-collecting chamber extends along the central region of the chin protector and in correspondence with the height of the latter, and is formed by a rubber-elastic wall mounted in an airtight fashion at a spacing on the inside of the chin protector and extending approximately in parallel to this inside, and one ventilating tube leads away from the end zones of the air-collecting chamber, each tube being guided in an arc to the tube end sections which latter form, as seen in lateral view, an angle of about 30° with the inside of the visor.

5. The safety helmet according to claim 3, wherein the free ends of the ventilating tubes have a narrowing flow cross section.

6. A safety helmet especially for users of automotive vehicles, comprising a viewing opening, visor means for the viewing opening, vent openings terminating into an air-collecting chamber located on the inside of a chin protector, at least one air-conducting channel leading from the air-collecting chamber to the upper zone of the viewing opening and the efflux direction of the air-conducting channel being extended from above obliquely and at an acute angle to the inside of the visor, and the air conducting channel includes a ventilating tube inserted in the lining of the safety helmet, wherein the chin protector is removable, the ventilating tubes each having a separating site, and the mutually facing tube ends being associated with cooperating sealing collars.

7. The safety helmet according to claim 1, wherein the vent openings are arranged at a section fashioned at the chin protector and extend inwardly in a frustoconical shape, and can be closed off entirely or partially by means of a slide.

8. The safety helmet according to claim 1, wherein the vent openings can be entirely or partially sealed by a rubber-elastic cover arranged on the inside of the chin protector.

9. The safety helmet according to claim 1, wherein a water drain hole leading to the underside of the helmet is provided in the zone of the lowest point of the air-collecting chamber.

10. The safety helmet according to claim 1, further comprising a bottom-positioned rim, extending radially from the safety helmet to the helmet wearer, projects obliquely downwardly from the helmet.

11. The safety helmet according to claim 1, wherein the vent openings are arranged at the chin protector.

12. A safety helmet especially for users of automotive vehicles, comprising a viewing opening, visor means for the viewing opening, vent openings terminating into an air-collecting chamber located on the inside of a chin protector, at least one air-conducting channel leading from the air-collecting chamber to the upper zone of the viewing opening and the efflux direction of the air-conducting channel being extended from above obliquely and at an acute angle to the inside of the visor, and the air conducting channel includes a ventilating tube inserted in the lining of the safety helmet, wherein the chin protector and the visor pivot together.

13. The safety helmet according to claim 1, wherein the vent openings are covered by a filter.

* * * * *